US006224527B1

(12) United States Patent
Pinchin et al.

(10) Patent No.: US 6,224,527 B1
(45) Date of Patent: May 1, 2001

(54) APPARATUS FOR BLOCKING TABBING FEATURE OF MAIL HANDLING SYSTEM AND ASSOCIATED METHODS

(75) Inventors: John R. Pinchin, Palm Bay; Vince Kubert, Melbourne, both of FL (US)

(73) Assignee: Profold, Inc., Sebastian, FL (US)

( * ) Notice: Subject to any disclaimer, the term of this patent is extended or adjusted under 35 U.S.C. 154(b) by 0 days.

(21) Appl. No.: 09/337,699

(22) Filed: Jun. 21, 1999

(51) Int. Cl.[7] ..... B31B 1/00
(52) U.S. Cl. ..... 493/11; 209/547; 209/584
(58) Field of Search ..... 493/11, 10, 15; 209/547, 584

(56) References Cited

U.S. PATENT DOCUMENTS 3,977,309 * 8/1976 Gilbert ..... 493/11
3,991,663 * 11/1976 Blasby ..... 493/11
4,809,340 * 2/1989 Mersereau ..... 209/584
5,393,366 * 2/1995 Bell ..... 156/443
5,841,881 * 11/1998 Iwakawa et al. ..... 209/584
5,891,300 4/1999 Oussani, Jr. et al. ..... 156/541

* cited by examiner

*Primary Examiner*—Eugene Kim
(74) *Attorney, Agent, or Firm*—Allen, Dyer, Doppelt, Milbrath & Gilchrist, P.A.

(57) ABSTRACT

An apparatus and methods for blocking a tabbing feature of a mail handling system are provided which preferably include a mail register positioned to register a plurality of pieces of mail being conveyed so that each selected edge of the plurality of pieces of mail aligns along a common path of travel, a mail presence detector positioned downstream from the mail register to detect the presence of each piece of mail as the piece of mail travels along the common path of travel, and a mail identifier positioned downstream from the mail detector and in communication with the mail detector to identify preselected pieces of mail which should not be tabbed. The apparatus also preferably includes a tab controller positioned in communication with the mail detector and the mail identifier to communicate to a tabber of a mail handling system to not tab the preselected pieces of mail.

17 Claims, 4 Drawing Sheets

APPARATUS FOR BLOCKING TABBING FEATURE OF MAIL HANDLING SYSTEM AND ASSOCIATED METHODS

FIELD OF THE INVENTION

The invention relates to the field of article handling and, more particularly, to the field of handling pieces of mail.

BACKGROUND OF THE INVENTION

Over the years, various article, e.g., mail, feeding, handling, sorting, and transporting systems have been developed for feeding, handling, sorting, and transporting pieces of mail. Adhesive tabs or seals have also been used to close or seal the loose edges of a paper, brochure, envelope, magazine or other articles of mail being handled or transported. The loose edge of a piece of mail, for example, is closed or sealed to allow the mail to be handled by feeding and processing machinery and to provide a degree of confidential nature to the closed or sealed mail. Increasing the speed and accuracy of placement of these tabs, however, has become more important as mail quantities increase, as labor becomes more expensive, and as more and improved automation is desired.

In order to provide significant improvements in the speed and efficiency in placing of these tabs, systems were developed for aligning and tabbing mail. An example of such a system can be seen in U.S. Pat. No. 5,393,366 by Bell titled "Aligning And Tabbing Method And Apparatus." This patent is also assigned to the same assignee of the present application. This patent describes an apparatus which rotates an article 90 degrees to be aligned properly to receive tabs.

Once these tabbing processes or this machinery is positioned into place in a mail handling process, however, it can be difficult to stop the process or to prevent some mail from receiving a tab. Additionally, in some mail handling processes, the fact that a piece of machinery provides tabbing to mail can make ready acceptance of the mail handling machinery difficult as well. Further, some mail handling machinery or systems require either the presence or absence of a tabber. No other option is provided.

SUMMARY OF THE INVENTION

In view of the foregoing background, the present invention advantageously provides an apparatus and method for blocking a tabbing feature of mail handling machinery so that selected pieces of mail are not tabbed. Also, the present invention advantageously provides an apparatus and method which allow intermixed pieces of mail to be readily identified as whether or not tabbing of the mail is desirable. Additionally, the present invention advantageously provides an apparatus and method which allows current mail tabbing machinery to be more readily accepted in some installation locations and allows ready modification of existing mail tabbing machinery to address concerns over various mail processing issues that inhibit use of such mail handling machinery. Further, the present invention advantageously provides an apparatus and method which enhances the speed of mail handling systems in situations where both tabbing and not tabbing mail is desirable.

More particularly, an apparatus of the present invention preferably includes a mail sensing device positioned to sense preselected pieces of mail for the presence of a mail identifier identifying that a preselected piece of mail should not be tabbed and a tab controller positioned in communication with the mail sensing device to communicate to a tabber of a mail handling system to not tab the preselected pieces of mail. The mail sensing device preferably includes a mail presence detector positioned to detect the presence of each piece of mail as the piece of mail travels along the common path of travel and a mail indicating identifier positioned in communication with the mail detector to identify preselected pieces of mail which should not be tabbed. The apparatus can also advantageously include a mail register positioned to register a plurality of pieces of mail being conveyed so that each selected edge of the plurality of pieces of mail aligns along a common path of travel and so that, in turn, the selected edge of the mail can be sense to determine the presence of a mail identifier, e.g., a plurality of spaced-apart marks, positioned along the selected edge.

The present invention also provides a method of preventing a piece of mail from being tabbed which preferably includes sensing the presence of a piece of mail, sensing the presence of a preselected identifier on the piece of mail, and communicating to a tabber of a mail handling system to not tab the piece of mail having the preselected identifier. The step of sensing the presence of a preselected identifier preferably includes sensing the presence of a first mark on the piece of mail, determining whether the first mark is within a predetermined contrast range between the first mark and the surrounding surface of the piece of mail, sensing the presence of a second mark on the piece of mail, determining whether the second mark is within a predetermined contrast range between the second mark and the surrounding surface of the piece of mail, and determining whether the time period between the sensing of the first and second marks is within a preselected range.

The present invention additionally provides a method of blocking a tabbing feature of a mail handling system which preferably includes registering a plurality of pieces of mail being conveyed so that each selected edge of the plurality of pieces of mail aligns along a common path of travel, detecting the presence of each piece of mail as the piece of mail travels along the common path of travel, identifying preselected pieces of mail which should not be tabbed, and communicating to a tabber of a mail handling system to not tab the preselected pieces of mail.

BRIEF DESCRIPTION OF THE DRAWINGS

Some of the features, advantages, and benefits of the present invention having been stated, others will become apparent as the description proceeds when taken in conjunction with the accompanying drawings in which.

DETAILED DESCRIPTION OF PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime and double prime notations are used to indicate similar elements in alternative embodiments.

Figure 1:
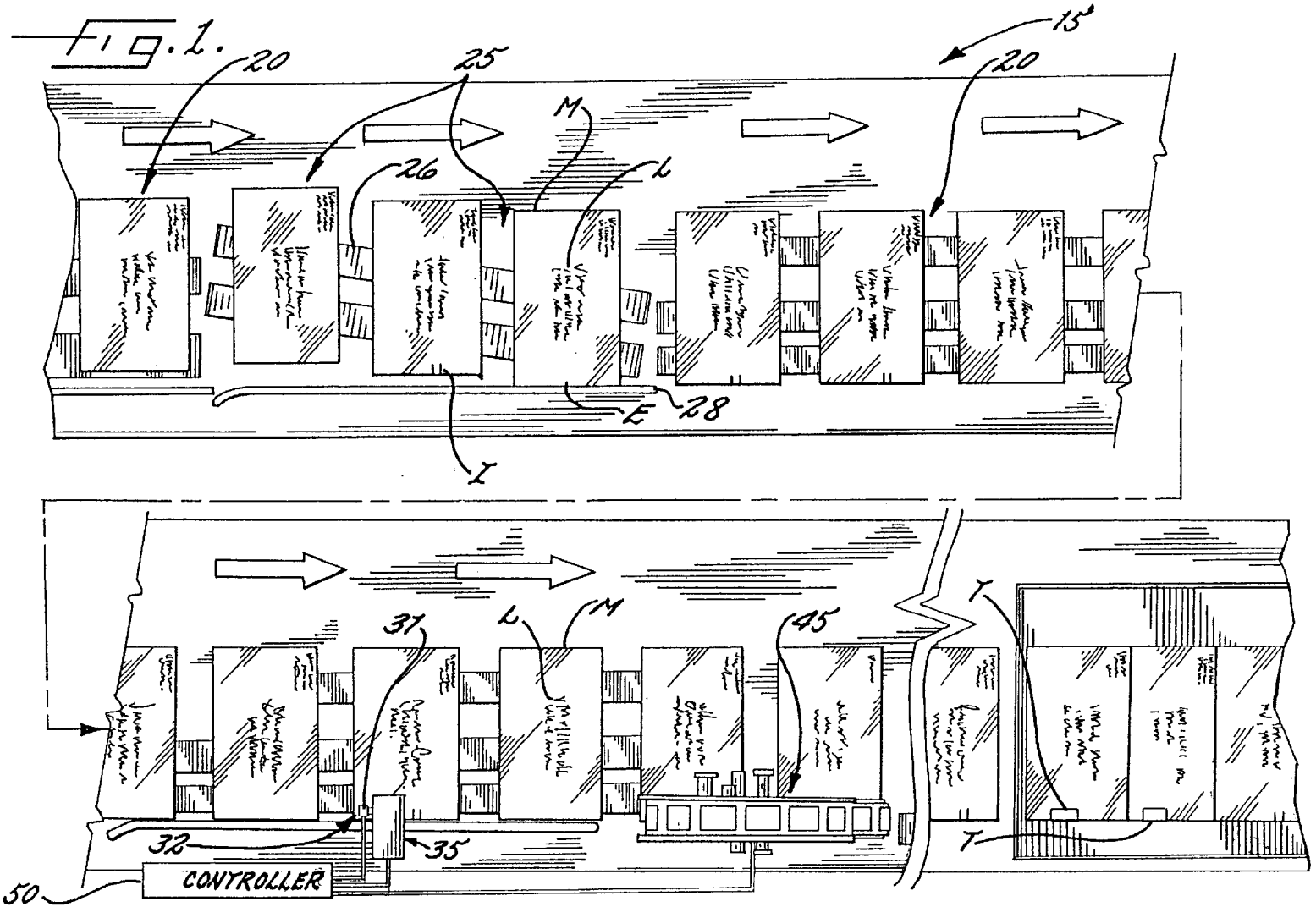
FIG. 1 is a top plan view of a plurality of pieces of mail traveling on a conveyor and being identified as not receiving a tab by an apparatus for blocking a tabbing feature of a mail handling system according to the present invention.
Figure 3:
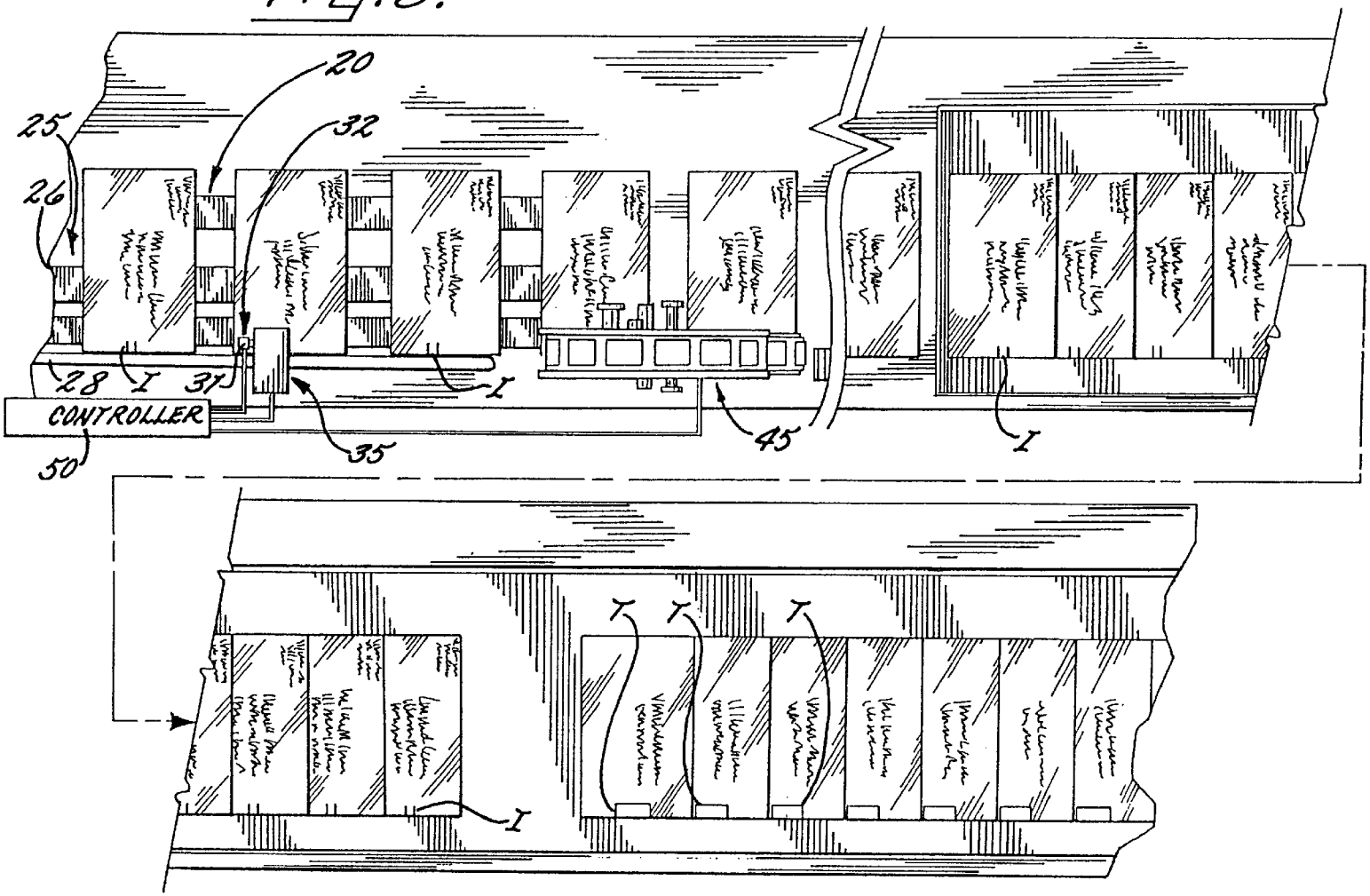
FIG. 3 is a top plan view of another mail handling job configuration of a plurality of pieces of mail traveling on a conveyor and being identified as not receiving a tab by an apparatus for blocking a tabbing feature of a mail handling system according to the present invention.
Figure 4:
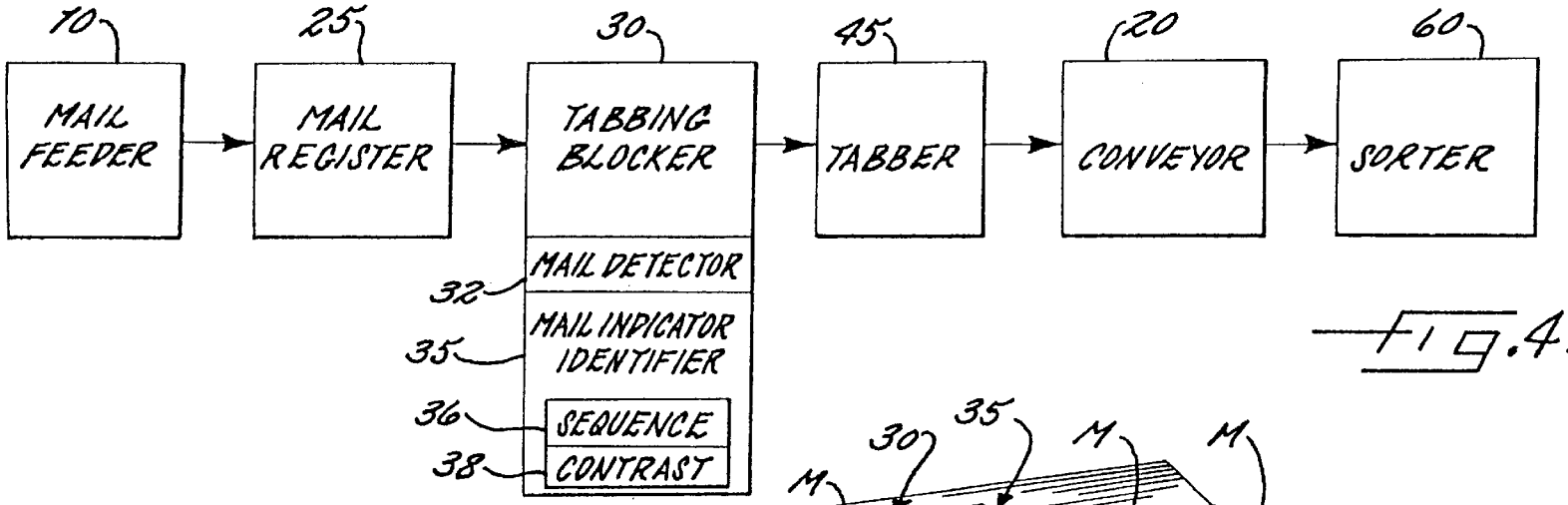
FIG. 4 is a schematic block diagram of an apparatus for blocking a tabbing feature of a mail handling system according to the present invention.
Figure 5:
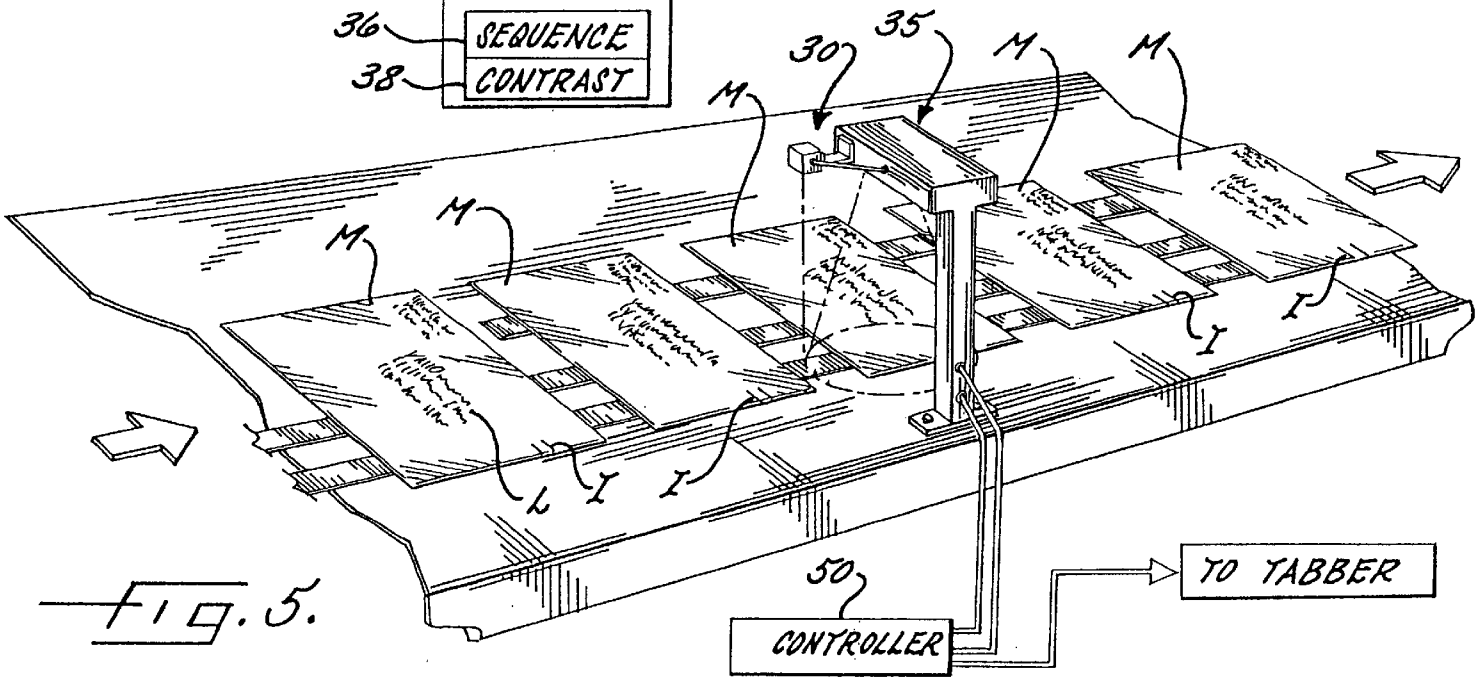
FIG. 5 is a perspective view of an apparatus for blocking a tabbing feature of a mail handling system according to the present invention.

FIGS. 1 and 4–5 illustrate an apparatus 15 for blocking a tabbing feature of a mail handling system according to the present invention. As illustrated, a mail handling system, for example, includes a mail feeder 10 which receives pieces of mail, e.g., in stacks, and feeds the mail downstream by the use of mail conveying means 20 for conveying a plurality of pieces of mail M along a predetermined direction of travel (as indicated by the arrows in FIGS. 1 and 3). The mail conveying means 20, which can form a portion of the apparatus 15 of the present invention, preferably is provided by a mail conveyor, e.g., formed of belts or chains, drive arms, and drive motors as understood by those skilled in the art, horizontally extending in a predetermined plane so that each of the pieces of mail M being conveyed thereby have an address label L which extends generally parallel to a mounting surface, e.g., a floor of a building, upon which the mail conveyor is mounted (see FIGS. 1 and 3–4).

The apparatus 15 then can include mail registering means 25, e.g., preferably provided by a mail register, positioned adjacent the mail conveying means 20 for registering the plurality of pieces of mail M being conveyed so that each selected edge E of the plurality of pieces of mail M aligns along a common path of travel. The mail register 25 is preferably provided by a mail conveying platform 26, e.g., mail carrying belts, positioned to convey or direct mail toward a registering guide rail 28 or guide member (see FIGS. 1 and 3). The guide rail 28 establishes a common path of travel for the mail M traveling on the conveying platform 26.

The apparatus 15 also preferably has mail detecting means 32 positioned downstream from the mail registering means 25 for detecting the presence of each piece of mail M as the piece of mail M travels along the common path of travel. The mail detecting means 32 is preferably provided by a mail presence detector 31 such as an optical sensor, e.g., photodiode, phototransistor, or optical camera, or a non-optical sensor which triggers or indicates that a preselected edge E of a piece of mail M has been sensed. The optical sensor is preferably positioned, e.g., overlying the mail as the mail M is being conveyed, to communicate to mail identifying means 35 positioned downstream therefrom, as described further herein, to initiate the sensing of the presence of a mail identifier I responsive to the sensing of the at least one selected edge E.

The apparatus 15 further preferably has mail identifying means 35 positioned downstream from the mail detecting means 32 and in communication with the mail detecting means 32 for identifying preselected pieces of mail M which should not be tabbed. For example, as shown in FIG. 1, the mail can be intermixed so that mail to be tabbed T and not tabbed run together on the same job. Alternatively, for example, a job to be tabbed T can run and then a job not to be tabbed can run on the same mail handling system without the necessity of removing the tabber 45 or disabling the tabber altogether (see FIG. 3). The mail identifying means 35 is preferably provided by a mail indicating identifier which senses the presence of a mail identifier I associated with, e.g., printed onto a surface of, a piece of mail M.

The apparatus 15 still further includes mail tabbing means 45, e.g., preferably provided by a mail tabber, positioned downstream from the mail identifying means 35 for tabbing pieces of mail M. The mail tabbing means 45 is preferably provided by a mail tabber of a mail handling system as understood by those skilled in the art and as described in the background section of the present application. Tab controlling means 50 is preferably positioned in communication with the mail detecting means 32, the mail identifying means 35, and the mail tabbing means 45 for communicating to not tab the preselected pieces of mail M. The tab controlling means 50 is preferably provided by a tab controller having one or more processors, e.g., microprocessors or computers as understood by those skilled in the art, which interface and communicate with the mail detecting means 32, the mail identifying means 35, and the mail tabbing means 45. The tab controlling means 50 also preferably includes a default condition which communicates to the mail tabbing means 45 to not tab the piece of mail M such as in the event of the occurrence of an error or error condition. This is significant because it is preferable that the apparatus 15 prevent a tab from occurring as a mistake condition than the possibility of a tab occurring as a mistake condition.

The mail handling system can further include mail sorting means 60 positioned downstream from the mail tabbing means 45 and positioned in communication with the tab controlling means 50 for sorting the preselected pieces of mail M which have not been tabbed into a sorting bin different from pieces of mail which have been tabbed (see FIG. 4). The mail sorting means 60 is preferably provided by a mail sorter which includes a plurality of mail sorting bins as understood by those skilled in the art. A conveyor 58 is preferably positioned between the tabber 45 and the sorter 60 so that mail can be selectively conveyed and guided into a predetermined sorting bin responsive to the tab controller 50.

Also, according to the present invention, identifying the presence of a mail identifier I on the mail M can be important. The mail identifying means 35 preferably includes an optical sensor positioned to overlie the mail conveyor 20 for sensing the presence of a mail identifier I positioned on the preselected pieces of mail M, e.g., in the embodiment of a conveyor which extends in the horizontal plane as illustrated. The optical sensor is preferably provided by one or more various optoelectronic sensors, e.g., photodiode or phototransistor, an optical camera, or other optical sensors as understood by those skilled in the art. The mail identifier I, for example, can advantageously be provided by a plurality of marks as illustrated positioned on, e.g., printed or adhesively attached to, the mail M along the edge E of the pieces of mail which would otherwise be tabbed T. Each of the plurality of marks preferably have at least a predetermined contrast between the mark and the surrounding surface of the piece of mail M.

The mail identifying means 35 further preferably includes mark sequence identifying means 37, e.g., provided by a mark sequence identifier, in communication with the optical sensor for identifying the occurrence of a predetermined mark sequence prior to initiating of a signal from the tab controlling means 50 to not tab the preselected piece of mail M. The mail identifying means 35 also further includes mark contrast determining means 39, e.g., provided by a mark contrast determiner, in communication with the optical sensor for determining the contrast of the plurality of marks with the surrounding surface of the mail. The mark sequence identifier means 37 and the mark contrast determiner 39 are preferably provided by software or software routines in association with a processor, e.g., a microprocessor or micro-controller as understood by those skilled in the art, or a combination of software and hardware in association with the optical sensor.

In addition, the mail presence detector 32 and the mail indicating identifier 35 can also together form a mail sensing device or a tabbing blocker 30 positioned to sense preselected pieces of mail M for the presence of a mail identifier I identifying that a preselected piece of mail should not be tabbed. An example of a combination for a mail sensing device is that shown and described, e.g., using separate optical sensors. Additionally, an optical camera or photographic camera can also accomplish both of these functions with a single optical sensor. Software and/or hardware for processing to interface with a camera is preferably used as well.

Each of the plurality of marks of the mail identifier I are preferably spaced-apart from each other a predetermined distance which directly relates to a selected timing reference so that the occurrence of the plurality of marks having an acceptable contrast within the selected timing reference responsively indicates to not tab the piece of mail M. Each of the plurality of marks has a predetermined width and a predetermined length within a selected range for the optical sensor to sense. The marks, for example, can be two parallel, spaced-apart lines having a selected width and length.

FIGS. 1–5 also illustrate methods of preventing mail from being tabbed. A method of preventing a piece of mail M from being tabbed preferably includes sensing the presence of a piece of mail, sensing the presence of a preselected mail identifier I on the piece of mail M, and communicating to a tabber 45 of a mail handling system to not tab the piece of mail M having the preselected identifier I. The step of sensing the presence of a preselected identifier I preferably includes sensing the presence of a first mark on the piece of mail M, determining whether the first mark is within a predetermined contrast range between the first mark and the surrounding surface of the piece of mail M, sensing the presence of a second mark on the piece of mail M, determining whether the second mark is within a predetermined contrast range between the second mark and the surrounding surface of the piece of mail M, and determining whether the time period between the sensing of the first and second marks is within a preselected range.

Figure 2:
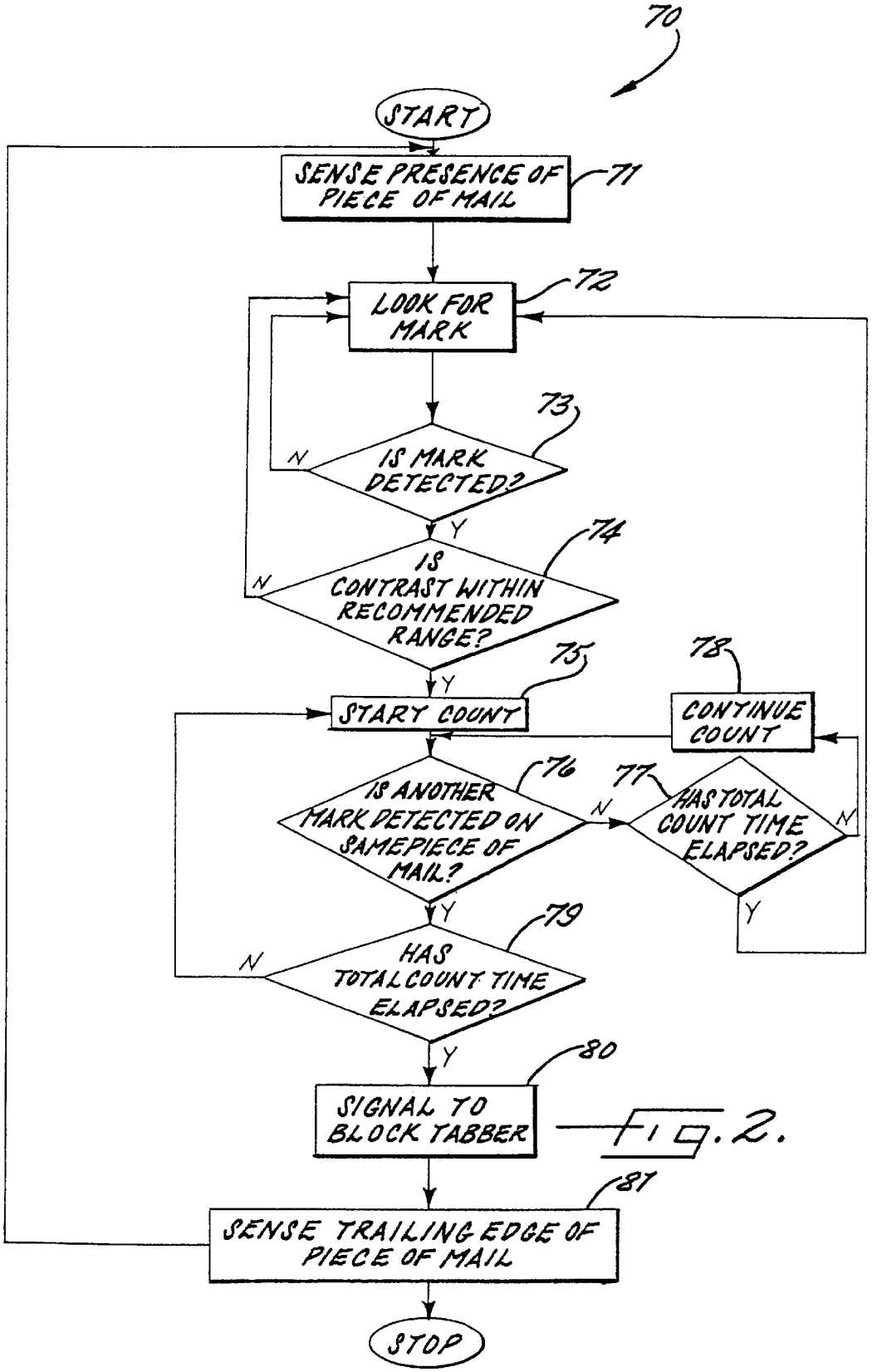
FIG. 2 is a schematic flow diagram of a method of identifying pieces of mail to block a tabbing feature of a mail handling system according to the present invention.

As FIG. 2 illustrates more particularly the methods 70 and operation of an embodiment of the present invention, the presence of a piece of mail is sensed 71 to initiate the sensing or searching for a mark 72 by the mail identifier 35. A determination is made as to whether a mark is detected 73. If not, then the search continues, If so, then whether the contrast between the mark and the surrounding surface of the mail is determined 74. If the contrast is within a recommended range, then a timing count is started 75. A searching or sensing of another mark is initiated 76. If no mark is detected, then the mail identifier determines whether a total count time has elapsed 77. If not, then the count continues 78. If so, then a first mark is searched for once again. If a second mark is detected, however, then whether a total count time has elapsed is determined 79. If not, then the count is restarted. If so, then a signal is communicated to the tabber that the tabbing feature is to be blocked 80. The trailing edge of the piece of mail 81 or the mail passing through a selected zone can then be determined to reinitiate the process for the next piece of mail.

A method of blocking a tabbing feature of a mail handling system is also provided which preferably includes registering a plurality of pieces of mail M being conveyed so that each selected edge E of the plurality of pieces of mail M aligns along a common path of travel, detecting the presence of each piece of mail M as the piece of mail M travels along the common path of travel, identifying preselected pieces of mail M which should not be tabbed, and communicating to a tabber 45 of a mail handling system to not tab the preselected pieces of mail M.

The step of identifying the preselected mail preferably includes determining the contrast of a plurality of marks on the mail M with the surrounding surface of the mail and identifying the occurrence of a predetermined mark sequence prior to communicating with the tabber 45 to not tab the preselected piece of mail M. Each of the plurality of marks are preferably spaced-apart from each other a predetermined distance which directly relates to a selected timing reference so that the occurrence of the plurality of marks having an acceptable contrast within the selected timing reference responsively indicates to not tab the piece of mail M.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the appended claims.

That which is claimed:

1. An apparatus for blocking a tabbing feature of a mail handling system, the apparatus comprising:

a mail register positioned to register a plurality of pieces of mail being conveyed so that each selected edge of the plurality of pieces of mail aligns along a common path of travel;

a mail presence detector positioned downstream from said mail register to detect the presence of each piece of mail as the piece of mail travels along the common path of travel;

a mail indicating identifier positioned downstream from said mail detector and in communication with said mail detector to identify preselected pieces of mail which should not be tabbed; and a tab controller positioned in communication with said mail detector and said mail identifier to communicate to a tabber of a mail handling system to not tab the preselected pieces of mail;

wherein said mail indicating identifier includes an optical sensor positioned to sense the presence of a mail identifier positioned on the preselected pieces of mail.

2. An apparatus as defined in claim 1, wherein the mail identifier includes a plurality of marks on the mail along the edge of the pieces of mail which would otherwise be tabbed, each of the plurality of marks having at least a predetermined contrast between the mark and the surrounding surface of the piece of mail.

3. An apparatus as defined in claim 2, wherein said optical sensor comprises a first optical sensor, and wherein said mail presence detector comprises a second optical sensor positioned upstream from said first optical sensor to sense the presence of at least one selected edge of the mail and to communicate to said first optical sensor to initiate the sensing of the presence of the mail identifier responsive to the sensing of the at least one selected edge.

4. An apparatus as defined in claim 3, wherein said mail indicating identifier further includes a mark sequence identifier in communication with said optical sensor to identify the occurrence of a predetermined mark sequence prior to initiating of a signal from said tab controller to not tab the preselected piece of mail and a mark contrast determiner positioned in communication with said optical sensor to determine the contrast of the plurality of marks with the surrounding surface of the mail.

5. An apparatus as defined in claim 4, wherein each of the plurality of marks are spaced-apart from each other a predetermined distance which directly relates to a selected timing reference so that the occurrence of the plurality of marks having an acceptable contrast within the selected timing reference responsively indicates to not tab the piece of mail.

6. An apparatus as defined in claim 5, wherein each of the plurality of marks has a predetermined width and a predetermined length within a selected range for said optical sensor.

7. An apparatus as defined in claim 6, wherein said tab controller includes a default condition which communicates to said mail tabbing means to not tab the piece of mail.

8. An apparatus for blocking a tabbing feature of a mail handling system, the apparatus comprising:

a mail sensing device positioned to sense preselected pieces of mail for the presence of a mail identifier identifying that a preselected piece of mail should not be tabbed; and a tab controller positioned in communication with said mail sensing device to communicate to a tabber of a mail handling system to not tab the preselected pieces of mail;

wherein said mail sensing device includes a mail presence detector positioned to detect the presence of each piece of mail as the piece of mail travels along the common path of travel and a mail indicating identifier positioned in communication with said mail detector to identify preselected pieces of mail which should not be tabbed.

9. An apparatus as defined in claim 8, wherein said mail indicating identifier includes an optical sensor positioned to sense the presence of a mail identifier positioned on the preselected pieces of mail.

10. An apparatus as defined in claim 9, wherein the mail identifier includes a plurality of marks on the mail along the edge of the pieces of mail which would otherwise be tabbed, each of the plurality of marks having at least a predetermined contrast between the mark and the surrounding surface of the piece of mail.

11. An apparatus as defined in claim 10, wherein said optical sensor comprises a first optical sensor, and wherein said mail presence detector comprises a second optical sensor positioned upstream from said first optical sensor to sense the presence of at least one selected edge of the mail and to communicate to said first optical sensor to initiate the sensing of the presence of the mail identifier responsive to the sensing of the at least one selected edge.

12. An apparatus as defined in claim 11, wherein said mail indicating identifier further includes a mark sequence identifier in communication with said optical sensor to identify the occurrence of a predetermined mark sequence prior to initiating of a signal from said tab controller to not tab the preselected piece of mail and a mark contrast determiner positioned in communication with said optical sensor to determine the contrast of the plurality of marks with the surrounding surface of the mail.

13. An apparatus as defined in claim 12, wherein each of the plurality of marks are spaced-apart from each other a predetermined distance which directly relates to a selected timing reference so that the occurrence of the plurality of marks having an acceptable contrast within the selected timing reference responsively indicates to not tab the piece of mail.

14. An apparatus as defined in claim 13, wherein each of the plurality of marks has a predetermined width and a predetermined length within a selected range for said optical sensor, and wherein said tab controller includes a default condition which communicates to said mail tabbing means to not tab the piece of mail.

15. A method of blocking a tabbing feature of a mail handling system comprising the steps of:

registering a plurality of pieces of mail being conveyed so that each selected edge of the plurality of pieces of mail aligns along a common path of travel;

detecting the presence of each piece of mail as the piece of mail travels along the common path of travel;

identifying preselected pieces of mail which should not be tabbed; and communicating to a tabber of a mail handling system to not tab the preselected pieces of mail;

wherein the step of identifying the preselected mail includes determinining the contrast of a plurality of marks on the mail with the surrounding surface of the mail and identifying the occurence of a predetermined mark sequence prior to cummunicating with the tabber to not tab the preselected piece of mail.

16. A method as defined in claim 15, wherein each of the plurality of marks are spaced-apart from each other a predetermined distance which directly relates to a selected timing reference so that the occurrence of the plurality of marks having an acceptable contrast within the selected timing reference responsively indicates to not tab the piece of mail.

17. An apparatus for tab processing an intermix of mail articles, the intermix being composed of mail articles preselected for tab processing and articles pre-selected for blocking from tab processing, the apparatus comprising:

a mail article conveyor for conveying mail articles along a designated path of conveyance;

a mail article feeder positioned upstream from the article conveyor along the designated path of conveyance for feeding mail articles to said conveyor at an initial point on the designated path of conveyance for subsequent conveyance of fed articles;

a mail article register positioned downstream from the initial point of conveyance adjacent the mail article conveyor for registering mail articles being conveyed so that selected edges of mail articles align along the designated path of conveyance;

a mail article presence detector positioned downstream from the initial point of conveyance adjacent the article conveyor for detecting the presence of mail articles being conveyed along the designated path of conveyance; and a mail article identifyer adjacent the mail article conveyor at a point downstream from the mail article presence detector for identifying mail articles pre-selected to be tab processed and mail articles pre-selected not to be tab processed.

* * * * *